United States Patent [19]

Knepper

[11] Patent Number: 4,872,661

[45] Date of Patent: Oct. 10, 1989

[54] ROLL RELEASE MECHANISM

[75] Inventor: James A. Knepper, Longmont, Colo.

[73] Assignee: International Business Machines Corporation, Armonk, N.Y.

[21] Appl. No.: 612,158

[22] Filed: May 21, 1984

[51] Int. Cl.[4] ..... B65H 5/02; B65H 5/04

[52] U.S. Cl. ..... 271/273; 271/314

[58] Field of Search ..... 271/272, 273, 274, 314; 29/115, 127, 128; 198/624, 627, 856; 100/168, 169, 171, 176; 226/176, 177, 179, 180, 192, 194

[56] References Cited

U.S. PATENT DOCUMENTS

| | | | |
|---|---|---|---|
| 3,252,311 | 5/1966 | Boyer | 68/253 |
| 3,443,408 | 5/1969 | Gutknecht | 68/253 |
| 3,661,383 | 5/1972 | Morrison | 271/273 |
| 3,856,461 | 12/1974 | Jordan | 100/176 |
| 4,046,372 | 9/1977 | Ebner | 271/273 |

*Primary Examiner*—Douglas C. Butler

*Attorney, Agent, or Firm*—J. Jancin, Jr.; C. E. Rohrer; Manny W. Schecter

[57] ABSTRACT

Roll release mechanism for pinch rolls are improved by providing capability for axial and radial disengagement of the pinch rolls and automatic roll re-engagement upon machine activation. One set of pinch rolls is mounted on a first shaft with a helical cam thereon. A spring latch and pawl are engaged to the first shaft and attached to a second multi-radius shaft parallel to the first shaft. A second set of pinch rolls are mounted on the second shaft so as to engage the first set of pinch rolls. Axial movement of the second shaft results in shaft areas of different radius being fitted within bearings thereby disengaging the pinch rolls. Disengagement is maintained against a spring force by the catching of the pawl on the cam. Machine activation then results in rotation of the first shaft until the pawl is released from the cam and the spring force moves the second shaft axially until the pinch rolls have re-engaged. In addition, the pinch rolls may be re-engaged manually.

17 Claims, 3 Drawing Sheets

ROLL RELEASE MECHANISM

BACKGROUND OF THE INVENTION

This invention relates to a roll release mechanism for easy jam clearance, and more specifically, to an apparatus for solving problems of pinch rolls located just beyond the aligner gate in paper handling systems.

Pinch roll feed mechanisms are subject to the problem of jamming of the fed item. For example, paper sheets may jam in the pinch rolls of a copier or laundry articles may jam in the wringers of a washing machine. If a jam occurs, the design configuration of a particular apparatus may not allow the operator to reach the jammed item. If the item is reachable, the rolls may not be rotatable with the machine power off. If the rolls are not separable, the operator will most likely be required to tear out the item. This results in pieces of the jammed item remaining in the roll mechanism which can cause subsequent jam failures.

Roll release mechanisms are known which allow the machine operator to remove a jammed item. Most roll release mechanisms allow the rolls to be moved radially for jam clearance while maintaining the rolls in a parallel relationship. Such known mechanisms are operated manually and thus subject to operator error and slow operating speeds. Roll release mechanisms including automatic roll re-engagement upon machine start-up have reduced these problems. Such known mechanisms release by pivoting one roll at one end. Design of these mechanisms requires strict maintenance of tolerances in order to return the rolls to a precise parallel orientation upon roll re-engagement. Automatic roll re-engagement has always employed positive closure forces which mash fingers should they be caught in the apparatus. Finally, these roll release mechanisms occupy much space and consist of an extensive number of parts.

SUMMARY OF THE INVENTION

The principal object of this invention is to provide an improved roll release mechanism for easy jam clearance which allows axial and radial disengagement of the rolls.

A further object of the invention is to provide an improved roll release mechanism in which the rolls may be re-engaged manually, or if not performed manually, automatically upon machine activation.

A still further object of the invention is to provide an improved roll release mechanism which allows for adjustability of the extent of roll release, the rate of roll release, and the rate of automatic roll re-engagement.

These and other objects are accomplished by providing drive rolls mounted on a first shaft with mating driven rolls mounted on a second shaft. An operator controlled handle is provided which when manually actuated moves the second shaft axially and radially to disengage the driven rolls from the drive rolls. The second shaft has areas of reduced radius which then fit within bearings and allow for the shaft's radial motion. Ramped radius areas on the second shaft, located between the areas of reduced and unreduced radius, allow the rolls to be re-engaged by sliding the second shaft axially and gradually increasing the radius of the second shaft fitted within the bearing.

A helical cam is located on the first shaft and a pawl for engaging the cam is connected to the second shaft. The pawl catches the cam when the rolls are disengaged and maintains the rolls in the disengaged position against the force of a spring tending to move the second shaft into the engaged position. If no manual re-engagement of the rolls has been performed prior to machine activation, rotation of the first shaft with the helical cam thereon allows the spring to move the pawl through the helix and off the cam, allowing the rolls to gradually re-engage. Manual re-engagement may be performed by the application of sufficient manual force to disengage the pawl from the cam and move the pawl axially until the rolls have re-engaged.

DETAILED DESCRIPTION OF THE PREFERRED EMBODIMENT

Figure 1:
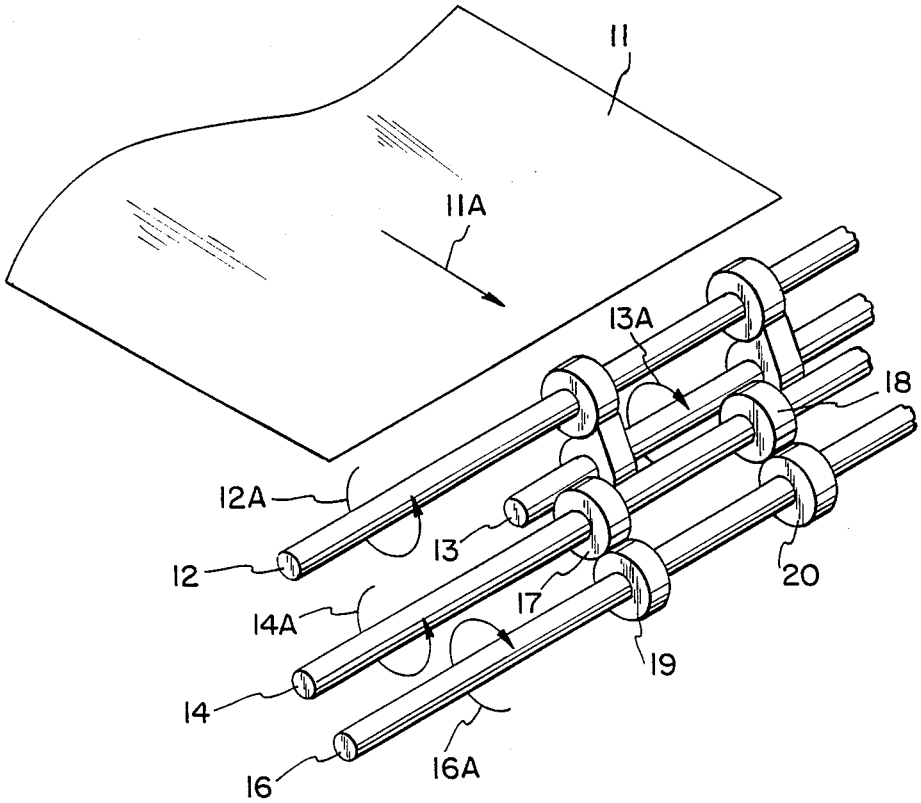
PRIOR ART FIG. 1
FIG. 1 is a schematic plan view of a sheet feeding mechanism as is typically found in the prior art.

FIG. 1 illustrates a sheet feeding mechanism for a paper handling system typical of those presently employed in the art. A paper sheet 11 is fed in the direction of arrow 11*a*. The sheet passes through the aligner gate, consisting of gate shafts 12 and 13 rotatable in the directions shown by arrows 12*a* and 13*a*, respectively. The sheet next reaches the pinch rolls 17, 18, 19, 20. Drive rolls 17 and 18 are mounted on feed roll drive shaft 14 which is powered for rotation in the direction of arrow 14*a* by means such as a cam drive. Shaft 16 is driven in rotation in the direction of arrow 16*a* by the interference fit of driven rolls 19 and 20 mounted thereon with drive rolls 17 and 18. Both drive and driven rolls are generally manufactured from high friction materials, thus the interference fit provides a non-slip drive force applied to the paper 11. A severe problem exists if the paper jams while still in the pinch rolls. Since the feed roll drive shaft 14 is machine powered, drive rolls 17 and 18 will not rotate with the machine power off. The machine operator must then tear the paper 11, resulting in paper pieces remaining in the copier which are capable of causing subsequent failures.

Figure 2:
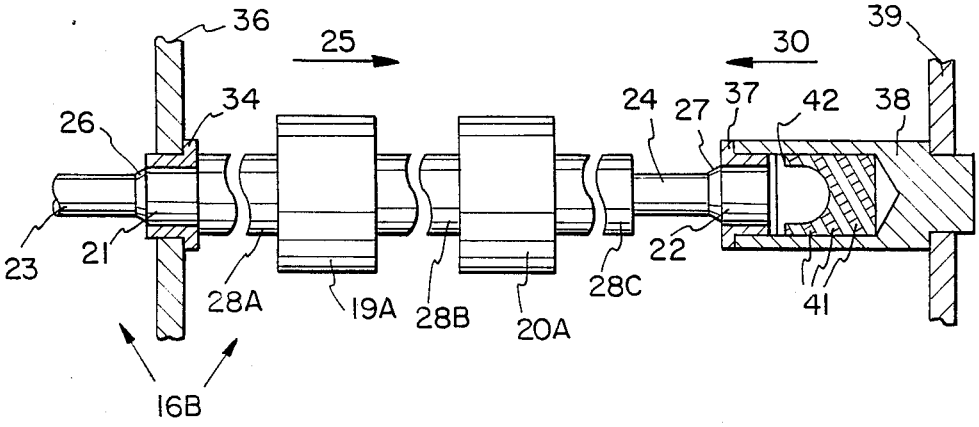
FIG. 2 is a cross-sectional view of the feed roll driven shaft according to the most preferred embodiment of the present invention, shown with the actuator handle removed.

FIG. 2 illustrates a feed roll driven shaft 16*b* which can be used to replace shaft 16 of FIG. 1 in the creation of a roll release mechanism providing for easy jam clearance and independent of any electrically actuated means. Shaft 16*b* is shown in the pitch rolls engaged position. Shaft 16*b* consists of a number of sections of different radius. Unreduced radius areas 21 and 22 of shaft 16*b* are fitted within front and rear bearings 34 and 37, respectively. Bearing 34 is press fit to be retained within front support plate 36. Bearing 37 is press fit to be retained within stand-off 38 which is in turn press fit to be retained within rear support plate 39. Reduced radius areas 23 and 24 of shaft 16*b* are joined to unreduced radius areas 21 and 22 by ramped radius areas 26 and 27, respectively. Driven rolls 19*a* and 20*a* are situated between shaft sections 28*a*, 28*b*, 28*c* of shaft 16*b*. Sections 28*a*, 28*b*, 28*c* are of a larger radius than said shaft areas 21 and 22. Rolls 19*a* and 20*a* in the invention replace rolls 19 and 20 of FIG. 1. A spring 41 is situated within stand-off 38 to bias spring guide 42 and shaft 16*b* in the engaging direction of arrow 30.

Figure 3:
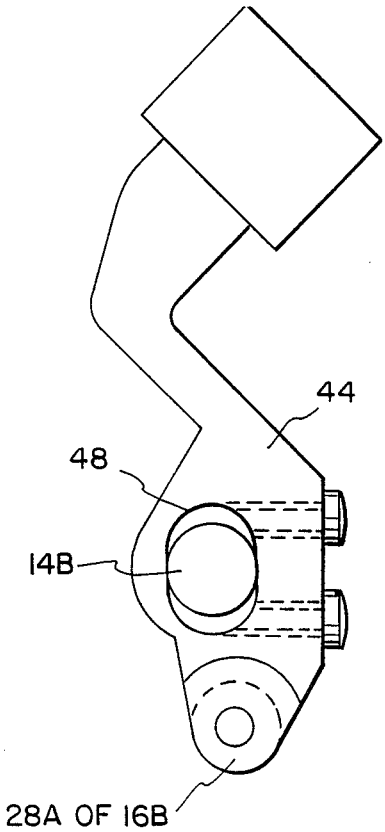
FIG. 3 is a front view of the actuator handle and parallel shafts with all other parts removed.

FIG. 3 illustrates the actuator handle 44 of the roll release mechanism. The actuator handle 44 was not shown in FIG. 2 to maintain clarity. However, actuator handle 44 is attached to shaft 16*b* in the shaft section 28*a* of FIG. 2. Shaft 14b replaces shaft 14 of FIG. 1. Shaft 14*b* runs through actuator handle slide hole 48 of actuator handle 44. Hole 48 is not perfectly round but elongated in the vertical direction of FIG. 3 to allow the actuator to slide over shaft 14*b* both radially and axially.

Figure 4:
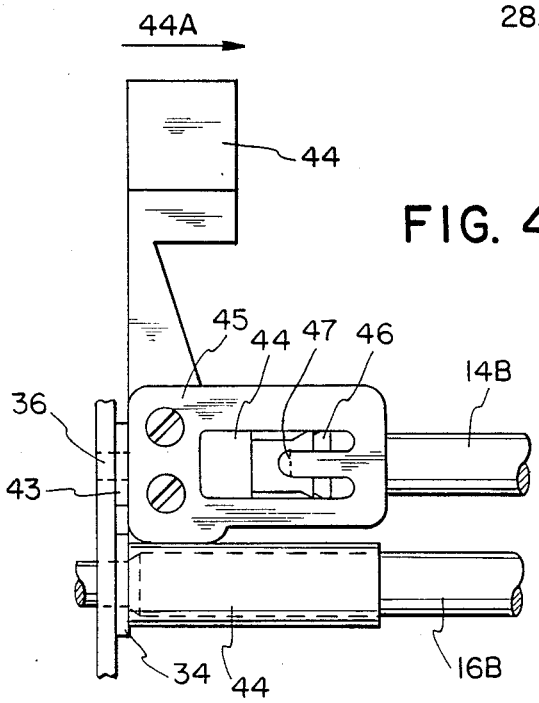
FIG. 4 is a side view of the actuator handle assembled with the parallel shafts and showing the helical cam.

FIG. 4 illustrates the actuator handle 44 as situated upon shafts 14*b* and 16*b* with the pinch rolls engaged. The section of shaft 16*b* shown corresponds to shaft section 28*a* of FIG. 2. Actuator handle 44 is maintained a distance away from support plate 36 by bearings 34 and 43. Spring latch 45 is attached to actuator handle 44 and extends outward axially over shaft 14*b*. Pawl 47 extends radially inward toward shaft 14*b*. Helical cam 46 is situated on shaft 14b axially rearward from pawl 47 and actuator handle 44.

Figure 5:
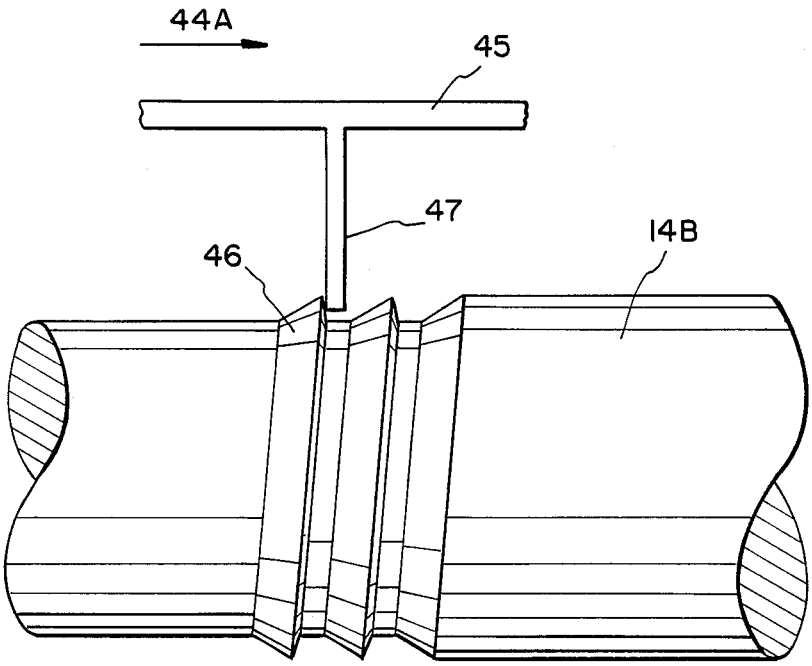
FIG. 5 is a side view of the pawl and helical cam on the feed roll drive shaft in position for roll disengagement.

FIG. 5 illustrates the pawl 47 and helical cam 46 of shaft 14*b* as they exist with the pinch rolls disengaged. To disengage the pinch rolls, the operator manually moves actuator handle 44 in the disengaging direction of arrow 44a in FIGS. 4 and 5 until pawl 47 engages the helical cam as shown in FIG. 5. Shaft 16*b* of FIG. 2 is thus moved in the disengaging direction of arrow 25 against the force of spring 41 until reduced radius areas 23 and 24 are fitted within bearings 34 and 37, respectively. Since reduced radius areas 23 and 24 are of smaller radius than bearings 34 and 37, shaft 16*b* is free to move in any radial direction until reduced radius areas 23 and 24 meet bearings 34 and 37, respectively. Thus, driven rolls 19*a* and 20*a* are disengaged axially and radially from their counterpart drive rolls. The engagement of pawl 47 with helical cam 46 serves to maintain shaft 16*b* in the pinch roll disengaged position despite the force of spring 41.

To re-engage the pinch rolls after removing the jammed paper, the operator need only start up the copier machine. Rotation of shaft 14*b* will allow spring 41 to gradually restore pawl 47 and shaft 16*b* to the pinch roll engaged position. The ramped radius areas 26 and 27 of shaft 16*b* will allow for easy fitting of unreduced radius areas 21 and 22 within bearings 34 and 37, respectively. The mechanism will then remain in the pinch roll engaged position until the operator pushes the actuator handle 44 again.

In summary, the present invention enables the pinch rolls of a paper handling system, to be disengaged axially and radially to facilitate the removal of jammed paper. The pinch rolls are automatically re-engaged upon machine activation. Such automatic re-engagement occurs without positive closure, reducing the likelihood of mashing fingers. In addition, the pinch rolls may be manually re-engaged by the application of sufficient force by the operator in the direction opposite to that shown by arrow 44*a* in FIG. 5. The rate of pinch roll disengagement and re-engagement may be adjusted by changing the slope of the ramped radius areas 26 and 27 of shaft 16*b*. The extent of pinch roll release may be adjusted by altering the radii of areas 21, 22, 23, 24 of shaft 16*b*. The automatic re-engagement restore rate may be adjusted by changing the helical angle of helical cam 46. Because the shafts are always maintained in parallel relation and there is no movement of the bearings, manufacturing tolerances and wear are minimized. Finally, because the present invention is based on the addition of only a few parts to existing technology, the design is simple and known reliable.

While the present invention has been described as a pinch roll release mechanism for a paper handling system, it should be evident that it has application in a variety of other fields wherein pinch rolls or shafts are to be disengaged. Accordingly, it should be understood that the invention should be limited only insofar as required by the scope of the following claims.

I claim:

1. A roll release mechanism for easy jam clearance including:

first and second parallel shafts with drive rolls mounted on said first one of said parallel shafts and mating driven rolls mounted on said second one of said parallel shafts so as to engage said drive rolls with said driven rolls, said second shaft having at least two areas of reduced radius and at least two areas of unreduced radius, said unreduced radius areas of said second shaft fitted within at least two bearings, said reduced radius areas of said second shaft fitted within said bearings to disengage said driven rolls axially and radially from said drive rolls upon axial movement of said second shaft in the disengaging direction.

2. The mechanism according to claim 1 additionally comprising means for manual re-engagement of said driven rolls with said drive rolls.

3. A roll release mechanism for easy jam clearance including:

first and second parallel shafts with drive rolls mounted on said first one of said parallel shafts and mating driven rolls mounted on said second one of said parallel shafts so as to engage said drive rolls with said driven rolls, said second shafts having at least two areas of reduced radius and at least two areas of unreduced radius, said unreduced radius areas of said second shaft fitted within at least two bearings, said reduced radius areas of said second shaft fitted within said bearings to disengage said driven rolls axially and radially from said drive rolls upon axial movement of said second shaft in the disengaging direction, and means for automatic re-engagement of said driven rolls with said drive rolls upon machine activation.

4. A roll release mechanism for easy jam clearance including:

first and second parallel shafts with drive rolls mounted on said first one of said parallel shafts and mating driven rolls mounted on said second one of said parallel shafts so as to engage said drive rolls with said driven rolls, said second shafts having at least two areas of reduced radius and at least two areas of unreduced radius, said unreduced radius areas of said second shaft fitted within at least two bearings, said reduced radius areas of said second shaft fitted within said bearings to disengage said driven rolls axially and radially from said drive rolls upon axial movement of said second shaft in the disengaging direction, means for manual re-engagement of said driven rolls with said drive rolls, and means for automatic re-engagement of said driven rolls with said drive rolls upon machine activation whenever the manual re-engagement has not been performed.

5. A roll release mechanism for easy jam clearance including:

first and second parallel shafts with drive rolls mounted on said first one of said parallel shafts and mating driven rolls mounted on said second one of said parallel shafts so as to engage said drive rolls with said driven rolls, said second shafts having at least two areas of reduced radius and at least two areas of unreduced radius, said unreduced radius areas of said second shaft fitted within at least two bearings, said reduced radius areas of said second shaft fitted within said bearings to disengage said driven rolls axially and radially from said drive rolls upon axial movement of said second shaft in the disengaging direction, means for automatic re-engagement of said driven rolls with said drive rolls upon machine activation, and means for eliminating positive closure forces during said automatic re-engagement of said rolls.

6. A roll release mechanism for easy jam clearance including:

first and second parallel shafts with drive rolls mounted on said first one of said parallel shafts and mating driven rolls mounted on said second one of said parallel shafts so as to engage said drive rolls with said driven rolls, said second shafts having at least two areas of reduced radius and at least two areas of unreduced radius, said unreduced radius areas of said second shaft fitted within at least two bearings, said reduced radius areas of said second shaft fitted within said bearings to disengage said driven rolls axially and radially from said drive rolls upon axial movement of said second shaft in the disengaging direction, means for manual re-engagement of said driven rolls with said drive rolls, means for automatic re-engagement of said driven rolls with said drive rolls upon machine activation whenever the manual re-engagement has not been performed, and means for eliminating positive closure forces during said automatic re-engagement of said rolls.

7. A roll release mechanism for easy jam clearance including:

first and second parallel shafts with drive rolls mounted on said first one of said parallel shafts and mating driven rolls mounted on said second one of said parallel shafts so as to engage said drive rolls with said driven rolls, said second shaft having at least two areas of reduced radius and at least two areas of unreduced radius, said second shaft having areas of ramped radius located between said reduced and unreduced radius areas, said unreduced radius areas of said second shaft fitted within at least two bearings, whereby axial movement of said second shaft in the disengaging direction results in said ramped radius areas of said second shaft fitting through and beyond said bearings until said reduced radius areas of said second shaft are fitted within said bearings thereby disengaging said driven rolls axially and radially from said drive rolls.

8. The mechanism according to claim 7 additionally comprising means for manual re-engagement of said driven rolls with said drive rolls.

9. The mechanism according to claim 8 additionally comprising means for automatic re-engagement of said driven rolls with said drive rolls upon machine activation whenever the manual re-engagement has not been performed.

10. The mechanism according to claim 9 additionally comprising means for eliminating positive closure forces during said automatic re-engagement of said rolls.

11. The mechanism according to claim 7 additionally comprising means for automatic re-engagement of said driven rolls with said drive rolls upon machine activation.

12. The mechanism according to claim 11 additionally comprising means for eliminating positive closure forces during said automatic re-engagement of said rolls.

13. A roll release mechanism for easy jam clearance including:

first and second parallel shafts with drive rolls mounted on said first one of said parallel shafts and mating driven rolls mounted on said second one of said parallel shafts so as to engage said drive rolls with said driven rolls, said second shaft having at least two areas of reduced radius and at least two areas of unreduced radius, said second shaft having ramped radius areas located between said reduced and unreduced radius areas, said unreduced radius areas of said second shaft fitted within at least two bearings, said second shaft having a spring located at one end and biased to move said shaft axially in the engaging direction, said first shaft having a helical cam thereon, said first shaft having a spring latch and pawl thereon with said spring latch also attached to said second shaft such that when said pawl catches on said cam said rolls are maintained in a disengaged position against the axial force of said spring until sufficient manual force is applied to release said pawl from said cam, whereby axial movement of said second shaft in the disengaging direction results in said ramped radius areas of said second shaft fitting through and beyond said bearings until said reduced radius areas of said second shaft are fitted within said bearings thereby disengaging said driven rolls axially and radially from said drive rolls and catching said pawl on said cam until the release of said pawl from said cam results in the fitting of said ramped radius areas of said second shaft through and beyond said bearings and said unreduced radius areas of said second shaft are again fitted within said bearings and said rolls are re-engaged.

14. The mechanism according to claim 13 additionally comprising means for rotating said first shaft upon machine activation to automatically re-engage said rolls whenever the manual re-engagement has not been performed, whereby the rotation of said first shaft release said pawl form said cam thereby fitting said ramped radius areas of said second shaft through and beyond said bearings and said unreduced radius areas of said second shaft are fitted within said bearings and said rolls are re-engaged.

15. A roll release mechanism for easy jam clearance including:

first and second parallel shafts with drive rolls mounted on said first one of said parallel shafts and mating driven rolls mounted on said second one of said parallel shafts so as to engage said drive rolls with said driven rolls, said second shaft having at least two area of reduced radius and at least two areas of unreduced radius, said second shaft having ramped radius areas located between said reduced and unreduced radius areas, said unreduced radius areas of said second shaft fitted through at least two bearings, said second shaft having a spring located at one end and biased to move said shaft axially, said first shaft having a helical cam thereon, said first shaft having a spring latch and pawl thereon with said spring latch also attached to said second shaft such that when said pawl catches on said cam said rolls are maintained in a disengaged position against the axial force of said spring, means for rotating said first shaft upon machine activation to release said pawl from said cam, whereby axial movement of said second shaft in the disengaging direction results in said ramped radius areas of said second shaft fitting through and beyond said bearings until said reduced radius areas of said second shaft are fitted within said bearings thereby disengaging said driven rolls axially and radially from said drive rolls and catching said pawl on said cam until the release of said pawl from said cam results in the fitting of said ramped radius areas of said second shaft through and beyond said bearings and said unreduced radius areas of said second shaft are again fitted within said bearings and said rolls are re-engaged.

16. A papar handling system having rotatable pinch rolls for feeding paper,including:

a roll release mechanism for easy jam clearance including first and second parallel shafts having drive rolls mounted on said first one of said parallel shafts and mating driven rolls mounted on said second one of said parallel shafts so as to engage said drive rolls with said driven rolls, said second shaft having at least two areas of reduced radius and at least two areas of unreduced radius, said unreduced radius areas of said second shaft fitted within at least two bearings, said reduced radius areas of said second shaft fitted within said bearings to disengage said driven rolls axially and radially from said drive rolls upon axial movement of said second shaft in the disengaging direction.

17. A paper handling system having rotatable pinch rolls for feeding paper, including:

a roll release mechanism for easy jam clearance including first and second parallel shafts having drive rolls mounted on said first one of said parallel shafts and mating driven rolls mounted on said second one of said parallel shafts so as to engage said drive rolls with said driven rolls, said second shaft having at least two areas of reduced radius and at least two areas of unreduced radius, said unreduced radius areas of said second shaft fitted within at least two bearings, said reduced radius areas of said second shaft fitted within said bearings to disengage said driven rolls axially and radially from said drive rolls upon axial movement of said second shaft in the disengaging direction, and means for automatic re-engagement of said driven rolls with said drive rolls upon machine activation.

* * * * *

UNITED STATES PATENT AND TRADEMARK OFFICE

CERTIFICATE OF CORRECTION

PATENT NO. : 4,872,661

DATED : October 10, 1989

INVENTOR(S) : James A. Knepper

It is certified that error appears in the above-identified patent and that said Letters Patent is hereby corrected as shown below:

Column 6,
Claim 12, line 24 Delete "11" and insert therefor --10--.

Column 8
Claim 16, line 4 Delete "papar" and insert therefor --paper--.

Signed and Sealed this

Nineteenth Day of May, 1992

*Attest:*

*Attesting Officer*

DOUGLAS B. COMER

*Acting Commissioner of Patents and Trademarks*